US006876332B1

(12) United States Patent
Chung et al.

(10) Patent No.: US 6,876,332 B1
(45) Date of Patent: Apr. 5, 2005

(54) MULTIPLE-FREQUENCY ANTENNA STRUCTURE

(75) Inventors: Shyh-Jong Chung, Hsin-Chu Hsien (TW); Shen-Yi Liao, Yun-Lin Hsien (TW); Min-Chuan Wu, Tai-Chung (TW); Kuang-Yu Yen, Tai-Chung (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 10/605,970

(22) Filed: Nov. 11, 2003

(51) Int. Cl.[7] ..... H01Q 1/24
(52) U.S. Cl. ..... 343/702; 343/700 MS
(58) Field of Search ..... 343/702, 700 MS, 343/846, 873, 848; H01Q 1/24

(56) References Cited

U.S. PATENT DOCUMENTS 6,008,774 A 12/1999 Wu ..... 343/702
6,747,600 B2 * 6/2004 Wong et al. ..... 343/700 MS
2004/0017315 A1 * 1/2004 Fang et al. ..... 343/700 MS
2004/0027295 A1 * 2/2004 Huber et al. ..... 343/702

* cited by examiner

*Primary Examiner*—Hoanganh Le
(74) *Attorney, Agent, or Firm*—Winston Hsu

(57) ABSTRACT

A multiple-frequency antenna includes a feed-line and a first radiating element electrically connected to the feed-line. A tuning element is electrically connected to the first radiating element. The tuning element contains at least two stubs, each stub having a fixed end connected to the first radiating element and a free end spaced apart from each other. The first radiating element and the tuning element serve to generate a first and a third operating frequency of the multiple-frequency antenna. The antenna also includes a second radiating element electrically connected to the feed-line, the second radiating element serving to generate a second operating frequency of the multiple-frequency antenna.

18 Claims, 6 Drawing Sheets

MULTIPLE-FREQUENCY ANTENNA STRUCTURE

BACKGROUND OF INVENTION

1. Field of the Invention

The present invention relates to a multiple-frequency antenna structure, and more specifically, to an antenna structure having a clamp-shaped tuning element.

2. Description of the Prior Art

The rapid development of the personal computer coupled with users' desires to transmit data between personal computers has resulted in the rapid expansion of local area networks. Today, the local area network has been widely implemented in many places such as in the home, public access areas, and the work place. However, the implementation of the local area network has been limited by its own nature. The most visible example of the limitation is the cabling. One solution to this problem is to provide personal computer with a wireless network interface card to enable the personal computer to establish a wireless data communication link. Using a wireless network interface card, a personal computer, such as a notebook computer, can provide wireless data transmission with other personal computers or with a host computing device such like a server connected to a conventional wireline network.

The growth in wireless network interface cards, particularly in notebook computers, has made it desirable to enable personal computers to exchange data with other computing devices and has provided many conveniences to personal computer users. As a key component of a wireless network interface card, the antenna has received much attention and many improvements, especially in function and size. FIG. 1 shows a PCMCIA wireless network interface card 8 used in a notebook computer. The card can be used with a PCMCIA slot built in a notebook computer. As shown, the wireless network interface card 8 comprises a main body 23, and an extension portion 12. The main body 23 further comprises driving circuitries, connectors, etc. The extension portion 12 comprises a printed antenna 10 for transmitting and receiving wireless signals. Presently, the antennas being used widely in a wireless network interface card include the printed monopole antenna, chip antenna, inverted-F antenna, and helical antenna. Among them, the printed monopole antenna is simple and inexpensive. As shown in FIG. 2, a printed monopole antenna 20 comprises a feed-line 21, a primary radiating element 22, a ground plane 24, and a dielectric material 25. The current on the printed monopole antenna is similar to current on a printed dipole antenna, so the electric field created will be the same. The difference is that the ground plane 24 of the printed monopole antenna 20 will create mirror current, so the total length of the printed monopole antenna 20 is only $\lambda g/4$, which is half of the length of a printed dipole antenna. The improvement on the length of an antenna is significant in application for wireless network interface cards. The definition of the wavelength $\lambda g$ described above is $$\lambda_\varepsilon = \frac{1}{\sqrt{\varepsilon_{nc}}} * \frac{c}{f_0}$$

Wherein $\varsigma$ is the speed of light, $f_{\dot{u}}$ is the center frequency of electromagnetic waves, and $\epsilon_{nc}$ is the equivalent dielectric constant and is between the nominal dielectric constant (around 4.4) of circuit board and the dielectric constant (around 1) of air. For example, if the center frequency is 2.45 GHz and the dielectric constant is 4.4, the length of the printed monopole antenna will be 2.32 cm. Since the space in a wireless network interface card reserved for an antenna is limited, an antenna with such length will not fit properly into a card, therefore, some modification for the antenna is required. In the U.S. Pat. No. 6,008,774 "Printed Antenna Structure for Wireless Data Communications", modification for such antenna is disclosed. As shown in FIG. 3, the shape of a printed monopole antenna 30 has been changed in order to reduce the size thereof. The concept of U.S. Pat. No. 6,008,774 is to bend the primary radiating element 22 of FIG. 2 into the form of a V-shaped primary radiating element 32 as shown in FIG. 3. Although the overall length of the primary radiating element 32 of U.S. Pat. No. 6,008,774 is still $\lambda g/4$ however, the space needed for furnishing this modified primary radiating element 32 is reduced. The antenna 30 shown in FIG. 3 also comprises a feed-line 31, the primary radiating element 32, a ground plane 34, and a dielectric material.

SUMMARY OF INVENTION

It is therefore a primary objective of the claimed invention to provide a multiple-frequency antenna in order to solve the above-mentioned problems.

According to the claimed invention, a multiple-frequency antenna includes a circuit board of dielectric material having a first surface and a second surface which is spaced apart from and is substantially parallel to the first surface, a ground plane layer of electrically conductive material covering a portion of the first surface of the circuit board, and a feed-line of electrically conductive material disposed on the second surface of the circuit board so as to extend over the ground plane layer. A first radiating element of electrically conductive material is electrically connected to the feed-line and disposed on the second surface so as not to extend over the ground plane layer. A tuning element of electrically conductive material is electrically connected to the first radiating element and disposed on the second surface so as not to extend over the ground plane layer. The tuning element contains at least two stubs, each stub having a fixed end connected to the first radiating element and a free end spaced apart from each other. The first radiating element and the tuning element serve to generate a first operating frequency of the multiple-frequency antenna. A second radiating element of electrically conductive material is electrically connected to the feed-line and disposed on the second surface so as not to extend over the ground plane layer, the second radiating element serving to generate a second operating frequency of the multiple-frequency antenna.

It is an advantage of the claimed invention that the multiple-frequency antenna contains the first and second radiating elements for transmitting and receiving signals at multiple frequencies. In addition, each of the first and second radiating elements is curved to reduce the amount of space needed to form the multiple-frequency antenna.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
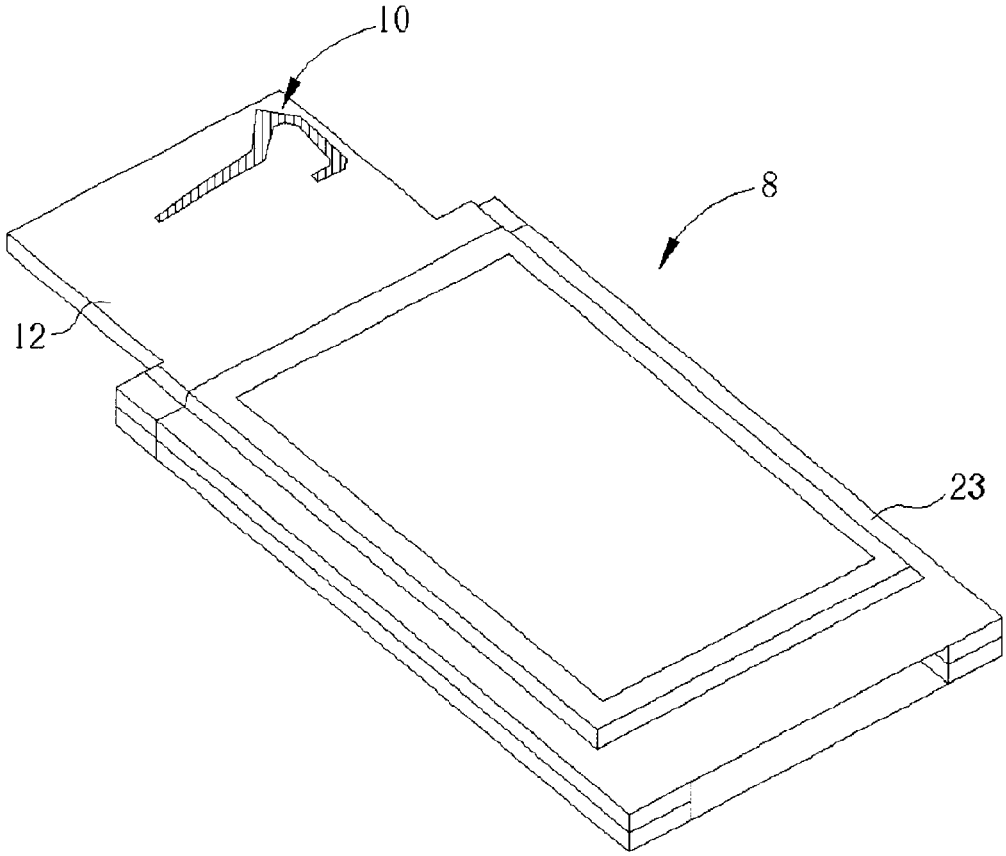
Fig. 1 Prior Art
FIG. 1 is a diagram showing a conventional wireless network interface card.
Figure 2:
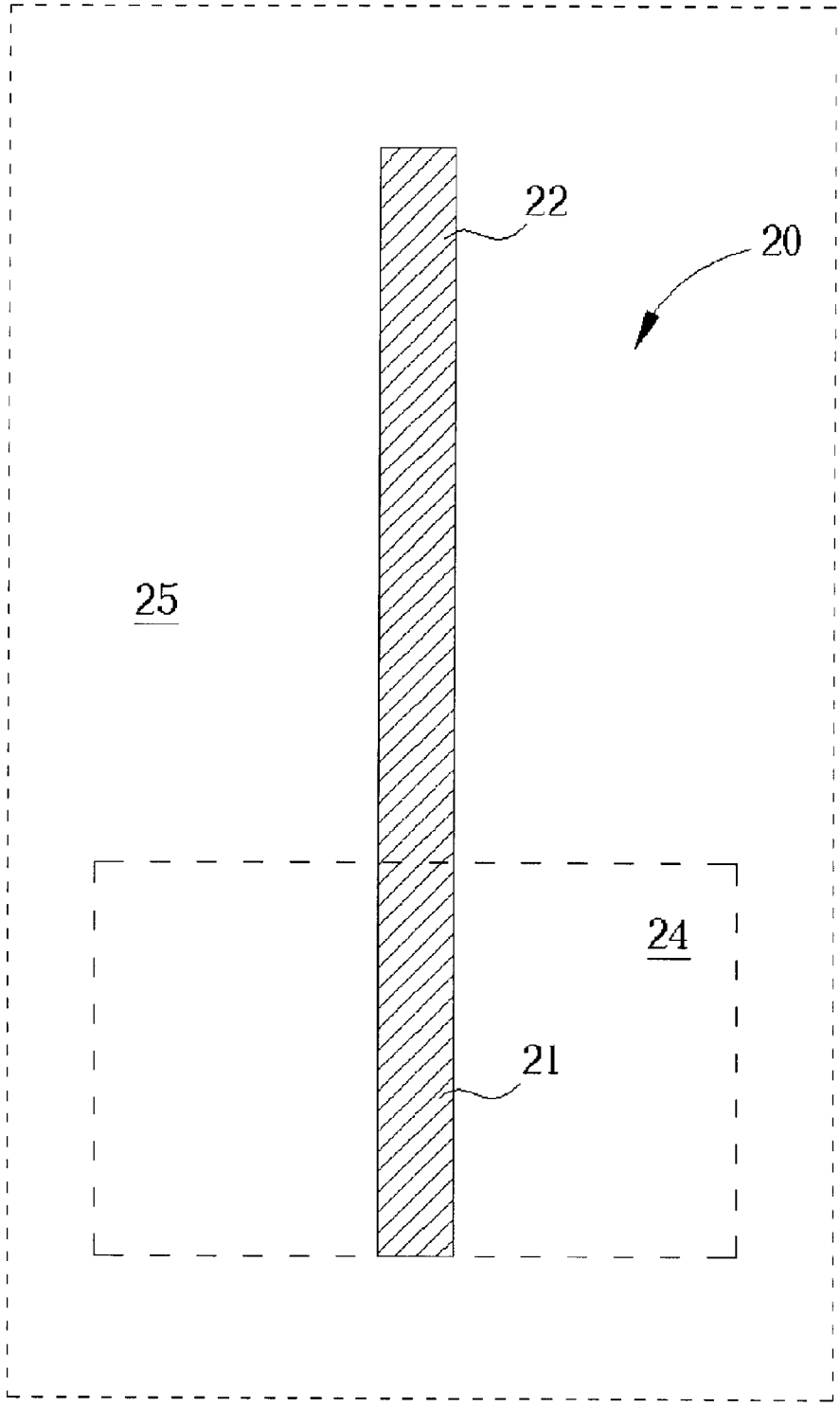
Fig. 2 Prior Art
FIG. 2 is a schematic diagram showing a conventional Printed Monopole Antenna.
Figure 3:
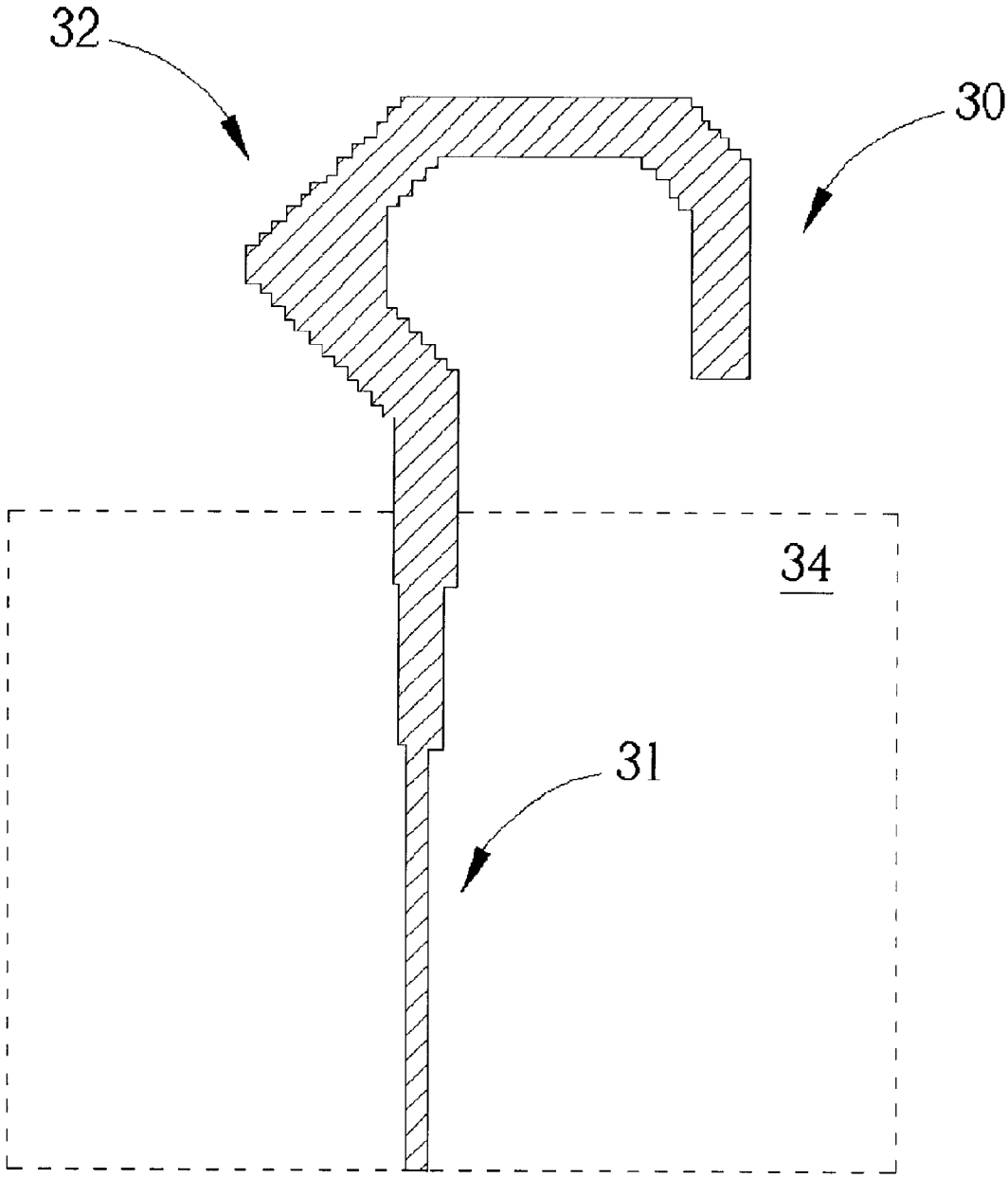
Fig. 3 Prior Art
FIG. 3 is a schematic diagram showing a conventional printed monopole antenna of U.S. Pat. No. 6,008,774.
Figure 4:
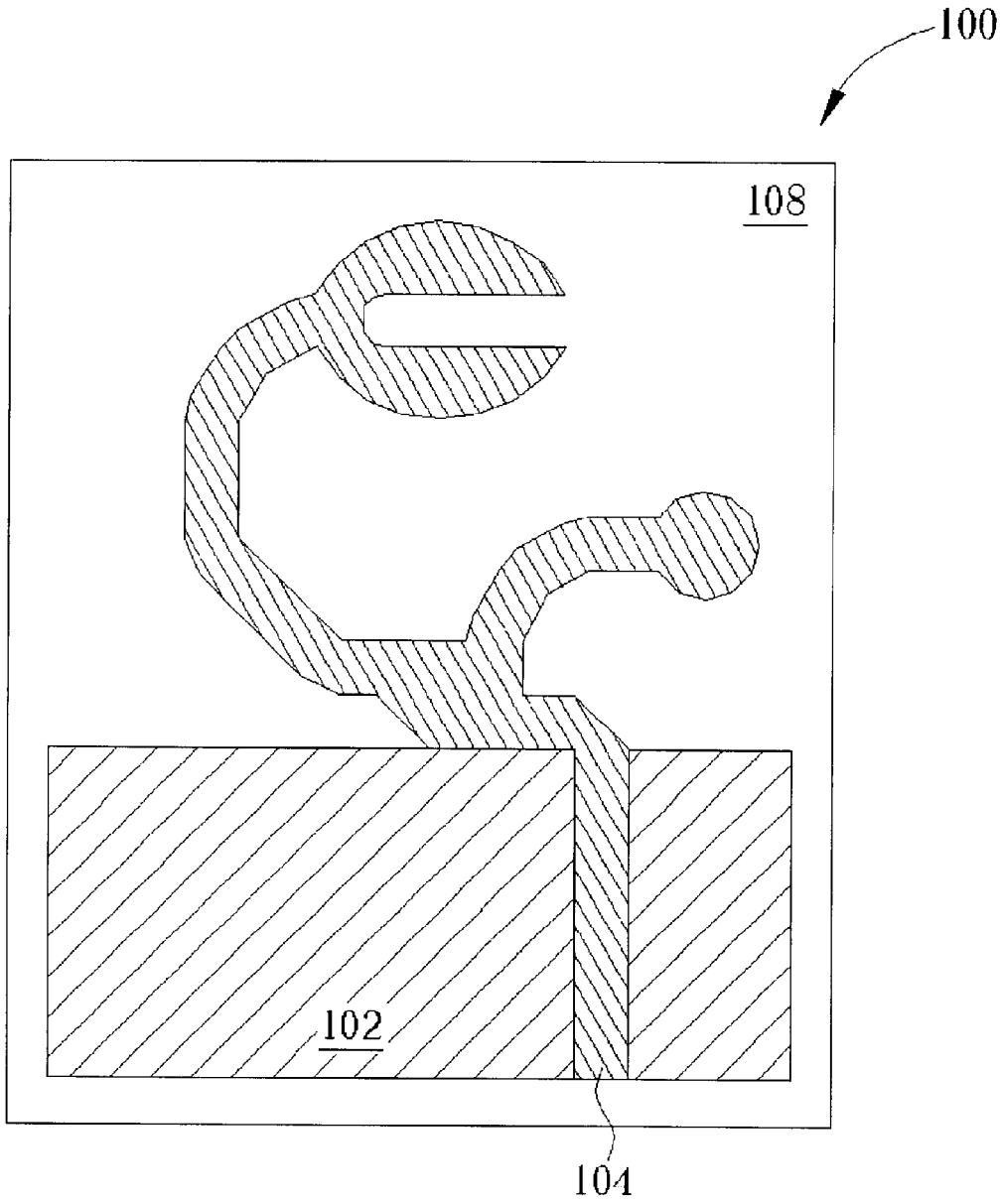
FIG. 4 is a diagram showing a multiple-frequency antenna according to the present invention.

Please refer to FIG. 4. FIG. 4 is a diagram showing a multiple-frequency antenna 100 according to the present invention. As shown, the antenna 100 is connected to a feed-line 104 for receiving and transmitting wireless signals. The antenna is formed on a dielectric layer 108 (for example, a circuit board made of dielectric material), and a ground plane layer 102 covers some portion of the bottom surface of the dielectric layer 108. The dielectric layer 108 (e.g. circuit board) has a bottom surface (the first surface) and a top surface (the second surface). These two surfaces are spaced apart from and are substantially parallel to each other. The feed-line 104 is on the top surface of the dielectric layer 108 and extends over the ground plane layer 102. One end of the feed-line 104 is connected electrically to driving circuitry (not shown in figures).

Figure 5:
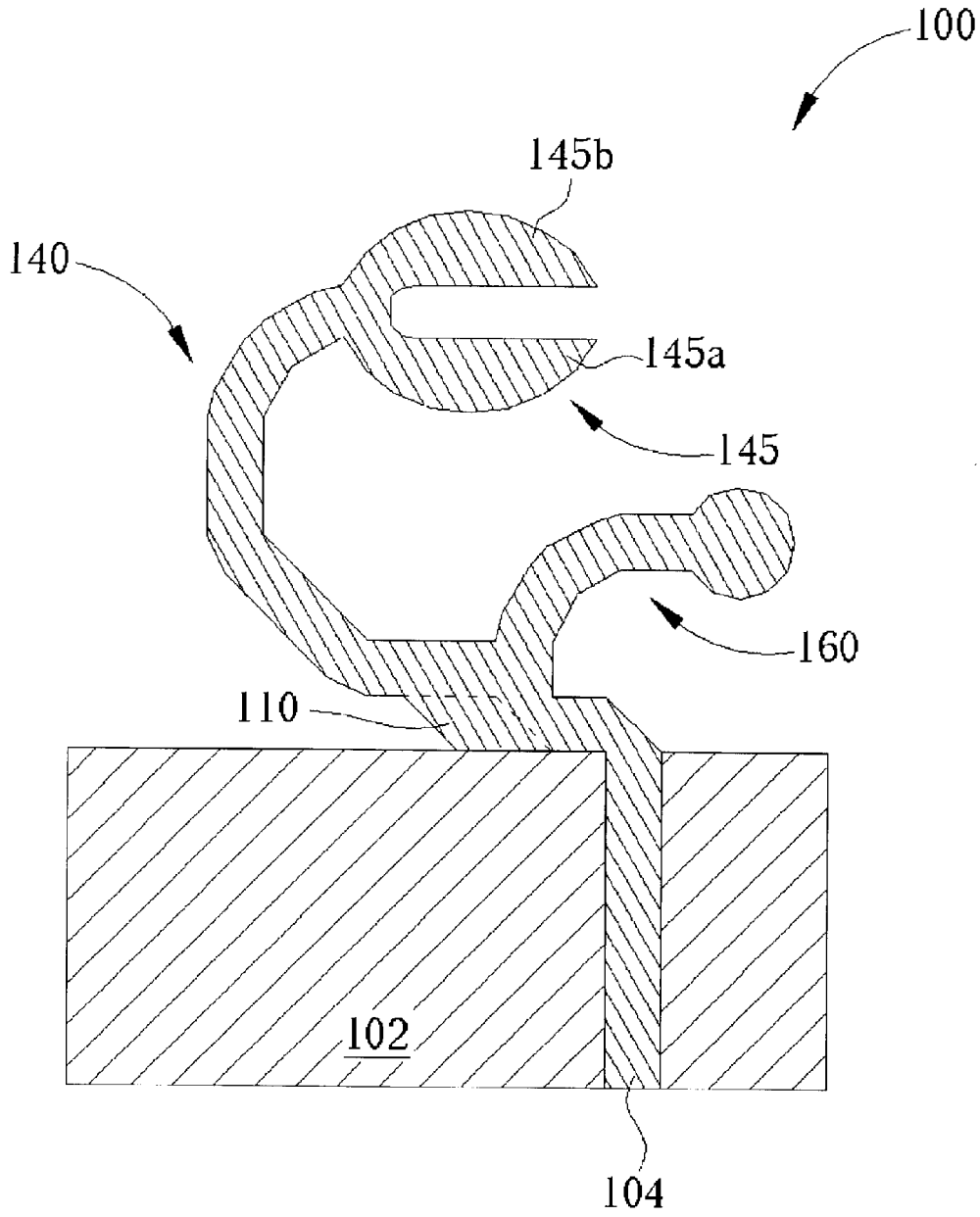
FIG. 5 is a detailed diagram of an antenna according to a preferred embodiment of the present invention.

Please refer to FIG. 5. FIG. 5 is a detailed diagram of an antenna 100 according to a preferred embodiment of the present invention. The antenna 100 comprises a first radiating element 140, a tuning element 145, and a second radiating element 160. The feed-line 104, first radiating element 140, tuning element 145, second radiating element 160, and ground plane layer 102 are all made of electrically conductive materials such as copper, nickel or gold. One end of the first radiating element 140 and one end of the second radiating element 160 are electrically connected to the feed-line 104 for emitting and receiving wireless signals. Together, the shape of the first radiating element 140 and the second radiating element 160 form the shape of a claw of a crab. Thus, the overall length of the radiation portion of the antenna remains the same and the area of the radiation portion of the antenna can be relatively small. However, this design is used as an example only. The first radiating element 140 and the second radiating element 160 can be any shape as long as the function of the design described above is accomplished. The tuning element 145 contains two stubs 145*a* and 145*b*. Each of the stubs 145*a* and 145*b* has an end connected to the first radiating element 140 and each also has a free end. In FIG. 5, the stubs 145*a* and 145*b* are shown as being substantially parallel to each other, and form a clamp shape, or the shape of a crab claw. The precise frequency range of the antenna can be adjusted by adjusting the length of the tuning element 145. Also, in order to decrease the area of the radiation portion of the antenna with the overall length of the radiating element unchanged, the tuning element 145 is divided into two substantially parallel parts 145*a* and 145*b*. However, this design is used as an example only. The tuning element can be divided into any number of parts, in any shape, and in any space relationship in between as long as the function of the design described above is accomplished.

Figure 6:
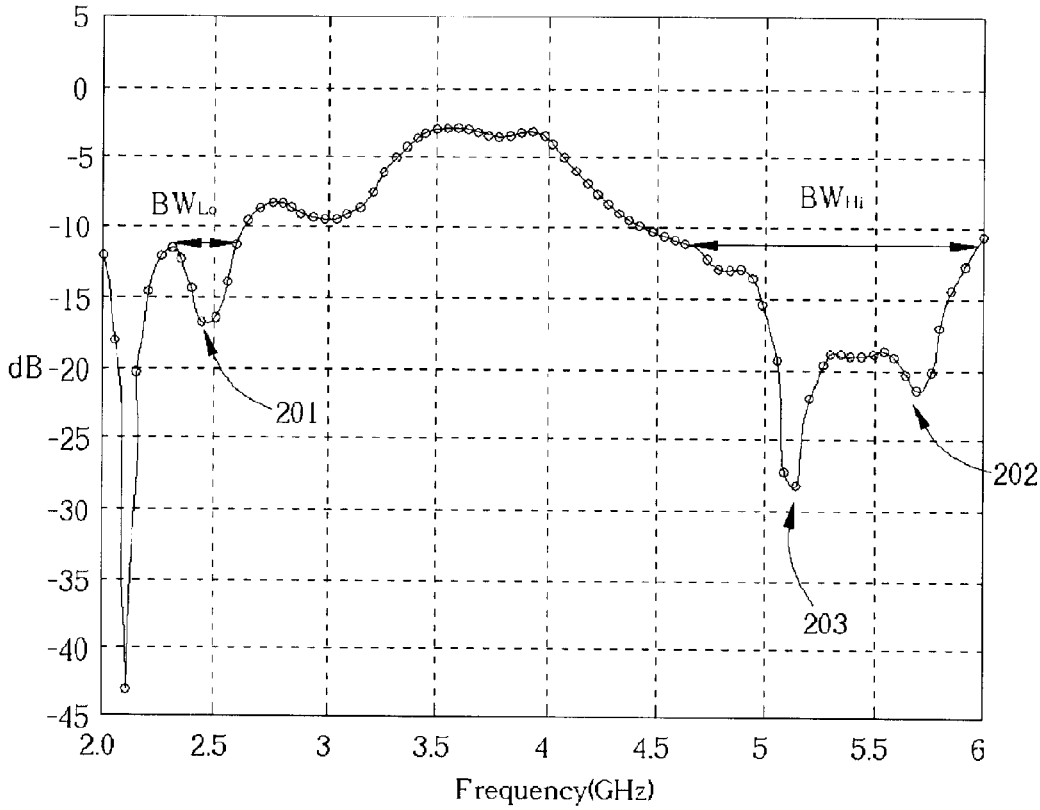
FIG. 6 is a plot diagram showing a relationship between return loss and frequency of the antenna according to the present invention.

Please refer to FIG. 6 with reference to FIG. 5. FIG. 6 is a plot diagram showing a relationship between return loss and frequency of the antenna 100 according to the present invention. Suppose that the first radiating element 140 has a length of L1, the tuning element 145 has a length of L2, and the second radiating element 160 has a length of L3. The first radiating element 140 and the tuning element 145 together serve to generate a first operating frequency 201 of the antenna 100. In FIG. 6, the first operating frequency 201 has a frequency of approximately 2.45 GHz. The first operating frequency 201 has a characteristic such that L1+L2 is about one-quarter wavelength of the first operating frequency 201. The second radiating element 160 serves to generate a second operating frequency 202 of approximately 5.7 GHz. The second operating frequency 202 has a characteristic such that L3 is about one-quarter wavelength of the second operating frequency 202.

Because of resonance effects that the second radiating element 160 has on the first radiating element 140, the first radiating element 140 together with the tuning element 145 resonate at a third operating frequency 203 of approximately 5.25 GHz. This third operating frequency 203 has a characteristic such that L1+L2 is about three-quarters wavelength of the third operating frequency 203. Please note that the wavelength of the operating frequency is related to the frequency of the input signal.

As shown in FIG. 6, the first operating frequency 201 forms a low frequency band. The low frequency band ranges from approximately 2300 MHz to 2600 MHz, for an effective bandwidth of 300 MHz. Because of the close proximity to each other, the second operating frequency 202 and the third operating frequency 203 together form an extra wide high frequency band, which is much wider than that of conventional antennas. The high frequency band ranges from approximately 4700 MHz to 5950 MHz, for an effective bandwidth of 1250 MHz. It should be noted that these frequency values are only for the antenna disclosed in this embodiment of the present invention. The frequency value can be varied through changing the factors related to the frequency value such as the material and the thickness (which have effect on the dielectric constant) of the PCB board and the electrically conductive material, the thickness of the first and the second radiating element, etc.

As shown in FIG. 5, the antenna 100 also contains an impedance matching portion 110. The impedance matching portion 110 is used in order to match the impedance of the antenna 100, and is added to the antenna 100 for improving transmission and reception characteristics of the antenna 100.

The antenna disclosed in the embodiment of the present invention uses the first radiating element 140 and the second radiating element 160 to generate three operating frequencies. In addition, two of the three operating frequencies form an extra wide high frequency band due to the close proximity to each other. The tuning element 145 is for adjusting the precise value of the operating frequencies. The shape of the first radiating element 140 and the second radiating element 160 form the shape of a claw of a crab and the tuning element is divided into two parallel parts.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An antenna, comprising:

a dielectric layer having a first surface and a second surface which is spaced apart from and is substantially parallel to the first surface;

a ground layer of electrically conductive material covering a portion of the first surface of the dielectric layer;

a feed-line of electrically conductive material disposed on the second surface of the dielectric layer;

a first radiating element of electrically conductive material electrically coupled to the feed-line, wherein the first radiating element is for generating a first and a third operating frequency of the antenna;

a tuning element of electrically conductive material electrically coupled to the first radiating element and disposed on the second surface for adjusting the overall length of the first radiating element, wherein the tuning element comprises at least two stubs, each stub having a fixed end coupled to the first radiating element and a free end spaced apart from each other; and a second radiating element of electrically conductive material electrically coupled to the feed-line and disposed on the second surface, wherein the second radiating element is for generating a second operating frequency of the antenna.

2. The antenna of claim 1 wherein the first radiating element in combination with the tuning element forms a length of about one-quarter wavelength of the first operating frequency.

3. The antenna of claim 1 wherein the second radiating element forms a length of about one-quarter wavelength of the second operating frequency.

4. The antenna of claim 1 wherein the first radiating element in combination with the tuning element forms a length of about three-quarters wavelength of the third operating frequency.

5. The antenna of claim 1 wherein the second and the third operating frequency are proximal to effectively from a first operating frequency band of the antenna.

6. The multiple-frequency antenna of claim 1 wherein the first operating frequency corresponds to a second frequency band of the antenna.

7. The multiple-frequency antenna of claim 1 wherein the stubs of the tuning element are parallel to each other.

8. The multiple-frequency antenna of claim 7 wherein the stubs of the tuning element and the first radiating element form a substantially claw-of-crab-shaped structure.

9. The multiple-frequency antenna of claim 1 further comprising an impedance matching portion electrically coupled to the first and second radiating elements for matching the impedance of the antenna.

10. An antenna, comprising:

a first radiating element having an overall length of L1;

a tuning element electrically coupled to one end of the first radiating element, the tuning element comprising at least two stubs, each stub having a free end spaced apart from each other and having an overall length of L2, wherein the first radiating element and the tuning element are for generating a first and a third operating frequency of the antenna; and a second radiating element electrically coupled to one end of the first radiating element, wherein the second radiating element has an overall length of L3 for generating a second operating frequency of the antenna;

wherein the first radiating element and the tuning element form a substantially claw-of-crab-shaped structure.

11. The antenna of claim 10 further comprising:

a printed circuit board of dielectric material having a first surface and a second surface which is spaced apart from and is substantially parallel to the first surface;

a ground layer of electrically conductive material covering a portion of the first surface of the printed circuit board; and a feed-line of electrically conductive material electrically coupled to the first and second radiating elements and disposed on the second surface of the printed circuit board;

wherein the first radiating element, the tuning element, and the second radiating element are both made of electrically conductive material and disposed on the second surface of the printed circuit board.

12. The multiple-frequency antenna of claim 10 wherein L1+L2 is about one-quarter wavelength of the first operating frequency.

13. The multiple-frequency antenna of claim 10 wherein L3 is about one-quarter wavelength of the second operating frequency.

14. The multiple-frequency antenna of claim 10 wherein L1+L2 is about three-quarters wavelength of the third operating frequency.

15. The antenna of claim 10 wherein the second and the third operating frequency are proximal to effectively from a first operating frequency band of the antenna.

16. The multiple-frequency antenna of claim 10 wherein the first operating frequency corresponds to a second frequency band of the antenna.

17. The multiple-frequency antenna of claim 10 wherein the stubs of the tuning element are parallel to each other.

18. The multiple-frequency antenna of claim 10 further comprising an impedance matching portion electrically connected to the first and second radiating elements for matching the impedance of the multiple-frequency antenna and improving transmission and reception characteristics of the multiple-frequency antenna.

* * * * *